United States Patent [19]

Kunikane et al.

[11] 4,306,014

[45] Dec. 15, 1981

[54] PHOTO-SENSITIVE AND HEAT-SENSITIVE COMPOSITION AND RECORDING ELEMENT USING SAME

[75] Inventors: Makoto Kunikane, Chigasaki; Akiyoshi Yasumori; Kiyoshi Taniguchi, both of Yokohama; Tetu Yamamuro, Mito, all of Japan

[73] Assignee: Ricoh Co., Ltd., Tokyo, Japan

[21] Appl. No.: 135,747

[22] Filed: Mar. 31, 1980

[30] Foreign Application Priority Data

Apr. 3, 1979 [JP] Japan ..... 54-39348

[51] Int. Cl.[3] ..... G03C 1/52

[52] U.S. Cl. ..... 430/338; 430/341; 430/337; 430/936; 430/340; 430/342; 430/343; 430/344; 430/141; 430/156; 430/159; 430/161; 430/164; 430/167; 430/177; 430/178; 430/179; 430/188; 430/196; 430/162

[58] Field of Search ..... 430/341, 337, 936, 338, 430/340, 342, 343, 344, 141, 156, 159, 161, 164, 167, 177, 178, 179, 188, 196, 162

[56] References Cited

U.S. PATENT DOCUMENTS

| | | | |
|---|---|---|---|
| 3,503,742 | 3/1970 | Yamada et al. | 430/337 |
| 3,658,543 | 4/1972 | Gerlach et al. | 430/343 |
| 4,124,392 | 11/1978 | Adin et al. | 430/341 |

*Primary Examiner*—Won H. Louie, Jr.

*Attorney, Agent, or Firm*—Blanchard, Flynn, Thiel, Boutell & Tanis

[57] ABSTRACT

A photo-sensitive and heat-sensitive composition consisting essentially of a leuco-pigment; a hydrogen donator; a photo-reductant which, when exposed to a visible light, produces a reducing agent by the action of said hydrogen donator coexisting therewith; a photooxidant which, when exposed to an ultraviolet ray, causes said leuco-pigment coexisting therewith to generate color and simultaneously, when reacted with said reducing agent, is deprived of its own oxidizing ability; and a cobalt complex which reacts with the reducing agent in amplifying manner to thereby suppress the reaction of a color-forming system, and a recording element using the same.

17 Claims, No Drawings

PHOTO-SENSITIVE AND HEAT-SENSITIVE COMPOSITION AND RECORDING ELEMENT USING SAME

BACKGROUND OF THE INVENTION (a) Field of the Invention

This invention is directed to a photo-sensitive and heat-sensitive composition which is devised to be fixed when irradiated with visible light and generate color when irradiated with ultraviolet radiation to thereby produce a high quality image, and a recording element comprising a support and a layer of said composition superposed thereon.

(b) Description of the Prior Art

A considerably large number of photo-sensitive compositions, photo-sensitive and heat-sensitive compositions and image-forming recording elements using said compositions have been widely utilized or proposed up to now. As typical examples, there can be enumerated, for instance, diazo copying materials using alkali media as developers, photographic films using silver salts, etc. However, the above-mentioned photo-sensitive compositions and recording elements are defective in the fact that developers and fixers must be used in order to obtain an image in practice.

As an attempt to eliminate the foregoing defect, accordingly, public attention has been attracted to dry photochemical photo-sensitive compositions and recording elements capable of forming images only with light as described in Japanese Patent Publications Nos. 19161/1968, 40150/1970, 17855/1972, Japanese Laid Open Patent Application No. 12879/1972, etc. For instance, the photo-sensitive composition as described in Japanese Patent Publication No. 19161/1968 comprises (a) a photooxidant such as hexaarylbiimidazole, tetraarylhydrazine or the like, (b) a color-generator such as leuco-pigment, hydrazone or the like and (c) a binary system redox couple comprising an oxidant component such as quinone, ketone or the like and a reductant component such as alcohol, ester or the like or a one component system redox couple such as 1,4-bis (2-methoxyethyl)anthraquinone or the like. The said photo-sensitive composition generates color by light of specific wavelength such as ultraviolet radiation (the color generating reaction is performed by the action of photooxidant and color-generator, and the originally generated color is deactivated permanently, that is, fixed by light of a different wavelength such as visible light (the fixing reaction is performed by the action of said redox couple). The use of the photo-sensitive composition of this type, accordingly, can obtain both positive image and negative image by selecting the sequence of irradiation of ultraviolet radiation and visible light, but is defective in that the fixing sensitivity (non-color-forming sensitivity) is still low. Accordingly, in order to obtain high contrast and clear-cut copies by using the conventional photo-sensitive components there was inevitably needed a long time period of exposure.

SUMMARY OF THE INVENTION

It is an object of this invention to provide a photo-sensitive and heat-sensitive composition capable of producing a copy which is exceedingly superior in both ultraviolet color-generating sensitivity and visible light non-color-forming (fixing) sensitivity and consequently clear-cut to a high extent.

In other words, the photo-sensitive and heat-sensitive composition according to this invention is characterized by consisting essentially of (a) a photooxidant capable of producing an oxidizing substance by irradiation of ultraviolet radiation, (b) a leuco-pigment generating color by the action of said oxidizing substance produced by ultraviolet radiation, (c) a photoreductant capable of producing a reducing substance by irradiation of visible light, (d) a hydrogen donator operable to supply hydrogen to said photoreductant and (e) a cobalt complex which reacts with said reducing substance in amplifying manner to thereby produce a substance acting to suppress the reaction of the color-generating system (for instance, $NH_3$ or the like).

In the composition according to this invention, the aforesaid two components (a) and (b) are a color-generating system and the aforesaid three components (c), (d) and (e) are a fixing system, but the composition per se is photo-sensitive in nature. Due to this, it is the general practice to prepare a mono-layer recording element comprising a support such as paper, plastic film or the like and a photo-sensitive and heat-sensitive layer which is formed by applying the composition onto the support so as to have a dry thickness of about 5–40 μm. Further, by the use of the composition of this invention there may be prepared a two-layer recording element having an about 5–20 μm-thick fixing layer and an about 1–20 μm-thick color-generating layer by the steps of dividing the composition into two systems, i.e., the fixing system and the color-generating system, applying onto a support the fixing system and the color-generating system in that order and drying. According to a similar application method, still further, there may be prepared a three-layer recording element comprising the provision of an about 1–10 μm-thick binder intermediate layer between the fixing layer and the color-generating layer for the purpose of enhancing mainly the color-forming sensitivity. In this case there can be employed a solvent and a binder in combination with the composition, that is, the color-generating system and/or fixing system, in order to facilitate the applying (coating) operation and improving the dispersion and adhesion of the respective elements used.

Next, reference will be made to the respective elements used in this invention.

The photooxidant used in this invention is a compound operable to produce an oxidizing substance by irradiation of ultraviolet radiation and oxidize a color-generator (leuco-pigment) with said oxidizing substance for color generating purposes, said compound comprising two types, that is, one is a compound operating as an initiator and the other is a compound operating as an acceptor. The initiator type photooxidants suitably used in this invention include hexaarylbiimidazoles and tetraarylhydrazines, and the acceptor type photooxidants suitably used in this invention include tetraacylhydrazines, diacylaminobenzotriazoles, benzothiazoledisulfides, triacylhydroxylamines, diacylaminotriazoles, alkylidene-2,5-cyclohexadiene-1-ones, a certain copolymer, diacylaminopyrazoles, bibenzotriazoles, etc. Their typical examples are enumerated as follows:

(A) Hexaarylbiimidazoles 2,2′-bis(p-methoxyphenyl)-4,4′,5,5′-tetraphenylbiimidazole, 2,2′-bis(p-cyanophenyl)-4,4′,5,5′-tetrakis(p-methoxyphenyl)biimidazole, 2,8′-bis(p-cyanophenyl)-4,4′,5,5′-tetrakis(p-methoxyphenyl) biimidazole,
2,2′-bis(3,4,5-trimethylphenyl)-4,4′,5,5′-tetrakis(p-methylthiophenyl)biimidazole,
2,2′-bis(o-methoxyphenyl)-4,4′,5,5′-tetraphenylbiimidazole,
2,2′-bis(2,4-dichlorophenyl)-4,4′,5,5′-tetrakis(p-methoxyphenyl)biimidazole,
2,2′-bis(o-bromophenyl)-4,4′,5,5′-tetraphenylbiimidazole
2,2′-bis(2,4-dimethoxyphenyl)-4,4′,5,5′-tetraphenylbiimidazole,
2,2′-bis(o-chlorophenyl)-4,4′,5,5′-tetraphenylbiimidazole,
2,2′-bis(o-chlorophenyl)-4,4′,5,5′-tetrakis(m-methoxyphenyl) biimidazole,
2,2′-bis(o-chlorophenyl)-4,4′-bis(p-methoxyphenyl)-5,5′-diphenylbiimidazole, and
2,2′-bis(o-chloro-p-methoxyphenyl)-4,4′5,5′-tetraphenylbiimidazole.

(B) Tetraarylhydrazines tetraphenylhydrazine,
tetra-p-tolylhydrazine, and
tetrakis(p-methoxyphenyl)hydrazine.

(C) Tetraacylhydrazines tetraacetylhydrazine,
tetraformylhydrazine, and
tetrabenzoylhydrazine.

(D) Diacylaminobenzotriazoles 1-diacetylaminobenzotriazole, and
1-dibenzoylamino-5-chlorobenzotriazole.

(E) Benzothiazole disulfides bis(2-benzothiazolyl) disulfide, and
bis(6-methoxy-2-benzothiazolyl) disulfide.

(F) Triacylhydroxyamines

N,N,O-triacetylhydroxylamine,
N,N,O-tripropionylhydroxylamine,
N,N,O-tribenzoylhydroxylamine, and
N,N,O-tris(p-chlorobenzoyl)hydroxylamine.

(G) Diacylaminotriazoles 1-diacetylamino-3,5-diphenyl-1H-1,2,4-triazole,
1-dipropionylamino-3,5-diphenyl-1H-1,2,4,-triazole, and
1-dibenzoylamino-4,5-diphenyl-1H-1,2,3-triazole.

(H) Alkylidene-2,5-cyclohexadiene-1-ones 2,6-dimethyl-4-(1,1,3,3-tetrafluoro-1,3-dichloroisopropylidene)-2,5-cyclohexadien-1-one.

(I) Selected polymers polymethacrylaldehyde (J) Diacylaminopyrazoles 1-diacetylaminopyrazole, and
1-dipropionylamino-4-chloropyrazole.

(K) Bibenzotriazoles 1,2′-bibenzotriazole,
5,5′-dichloro-1,1′-bibenzotriazole, and
5,5′-dimethyl-1,1′-bibenzotriazole.

As the other photooxidants can be enumerated halogen compounds.

(L) Halogen compounds carbon tetraiodide (initiator type)
Iodoform (the same as above)
carbon tetrabromide (acceptor type)
1,2,3,4-tetrachlorobenzene (the same as above)
1,2,3,4-tetrabromobutane (the same as above)
Hexachloroethane (the same as above)

Of the above mentioned photooxidants, the hexaarylbiimidazoles can be represented by the formula

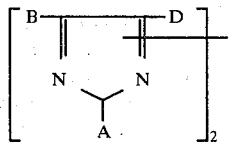

(wherein A, B and D stand for aryl radicals. The B and D groups normally carry 0–3 substituents, the A groups 0–4 substituents.) The aryl groups include one- and two-ring aryls, such as phenyl, biphenyl, naphthyl, pyridyl, furyl, thienyl and the like. The substituents may be halogen, cyano, lower hydrocarbyl (including alkyl, halo alkyl, cyanoalkyl, hydroxyalkyl, aryl and the like), lower alkoxy, aryloxy, lower alkylthio, arylthio, sulfo, alkylsulfonyl, nitro, lower alkylcarbonyl and the like. The alkyl groups are preferably of 1–6 carbon atoms, while aryl groups are preferably of 6–10 carbon atoms. And, preferable hexaarylbiimidazoles include 2,2′,4,4′,5,5′-hexaphenylbiimidazole bearing chlorine, bromine, fluorine, $C_1$–$C_6$ alkoxy or $C_1$–$C_6$ alkyl group at the ortho-position of the 2- and 2′-phenyl rings, most preferably 2,2′-bis(o-chlorophenyl)-4,4′,5,5′-tetraphenylbiimidazole.

The color-generator (leuco-pigment) is a substantially colorless compound which generates color upon undergoing the oxidizing action of an oxidizing substance coming from the photooxidant. And it, when contained in the composition, is naturally required to be stable under normal storage conditions. Such exemplary color-generators are enumerated as follows:

(a) Aminotriarylmethanes bis(4-amino-2-butylphenyl)(p-dimethylaminophenyl)methane
bis(4-amino-2-chlorophenyl)(p-aminophenyl)methane
bis(4-amino-3-chlorophenyl)(o-chlorophenyl)methane
bis(4-amino-3-chlorophenyl)phenylmethane
bis(4-amino-3,5-diethylphenyl)(o-chlorophenyl)methane
bis(4-amino-3,5-diethylphenyl)(o-ethoxyphenyl)methane
bis(4-amino-3,5-diethylphenyl)(p-methoxyphenyl)methane
bis(4-amino-3,5-diethylphenyl)phenylmethane
bis(4-amino-3-ethylphenyl)(o-chlorophenyl)methane
bis(p-aminophenyl)(4-amino-m-tolyl)methane
bis(p-aminophenyl)(o-chlorophenyl)methane
bis(p-aminophenyl)(p-chlorophenyl)methane
bis(p-aminophenyl)(2,4-dichlorophenyl)methane
bis(p-aminophenyl)(2,5-dichlorophenyl)methane
bis(p-aminophenyl)(2,6-dichlorophenyl)methane
bis(p-aminophenyl)phenylmethane bis(4-amino-o-tolyl)(p-chlorophenyl)methane
bis(4-amino-o-tolyl)(2,4-dichlorophenyl)methane
bis(p-anilinophenyl)(4-amino-m-tolyl)methane
bis(4-benzylamino-2-cyanophenyl)(p-aminophenyl)methane
bis(p-benzylethylaminophenyl)(p-chlorophenyl)methane
bis(p-benzylethylaminophenyl)(p-diethylaminophenyl)methane
bis(p-benzylethylaminophenyl)(p-dimethylaminophenyl)methane
bis(4-benzylethylamino-o-tolyl)(p-methoxyphenyl)methane
bis(p-benzylethylaminophenyl)-phenylmethane
bis(4-benzylethylamino-o-tolyl)(o-chlorophenyl)methane
bis(4-benzylethylamino-o-tolyl)(p-diethylaminophenyl)methane
bis(4-benzylethylamino-o-tolyl)(4-diethylamino-o-tolyl)methane
bis(4-benzylethylamino-o-tolyl)(p-dimethylaminophenyl)methane
bis[2-chloro-(2-diethylaminoethyl)ethylaminophenyl]-(o-chloro-phenyl)methane
bis[p-bis(2-cyanoethyl)aminophenyl]phenylmethane
bis[p-(2-cyanoethyl)ethylamino-o-tolyl](p-dimethylaminophenyl)methane
bis[p-(2-cyanoethyl)methylaminophenyl](p-diethylaminophenyl)methane
bis(p-dibutylaminophenyl)[p-(2-cyanoethyl)methylaminophenyl]methane
bis(p-dibutylaminophenyl)(p-diethylaminophenyl)methane
bis(4-diethylamino-2-butoxyphenyl)(p-diethylaminophenyl)methane
bis(4-diethylamino-2-fluorophenyl)o-tolylmethane
bis(p-diethylamino)(p-aminophenyl)methane
bis(p-diethylaminophenyl)(4-anilino-1-naphthyl)methane
bis(p-diethylaminophenyl)(m-butoxyphenyl)methane
bis(p-diethylaminophenyl)(o-chlorophenyl)methane
bis(p-diethylaminophenyl)(p-cyanophenyl)methane
bis(p-diethylaminophenyl)(2,4-dichlorophenyl)methane
bis(p-diethylaminophenyl)(4-diethylamino-1-naphthyl)methane
bis(p-diethylaminophenyl)(p-dimethylaminophenyl)methane
bis(p-diethylaminophenyl)(4-ethylamino-1-naphthyl)methane
bis(p-diethylaminophenyl)2-naphthylmethane
bis(p-diethylaminophenyl)(p-nitrophenyl)methane
bis(p-diethylaminophenyl)2-pyridylmethane
bis(p-diethylamino-m-tolyl)(p-diethylaminophenyl)methane
bis(4-diethylamino-o-tolyl)(o-chlorophenyl)methane
bis(4-diethylamino-o-tolyl)(p-diethylaminophenyl)methane
bis(4-diethylamino-o-tolyl)(p-diphenylaminophenyl)methane
bis(4-diethylamino-o-tolyl)phenylmethane
bis(4-dimethylamino-2-bromophenyl)phenylmethane
bis(p-dimethylaminophenyl)(4-anilino-1-naphthyl)methane
bis(p-dimethylaminophenyl)(p-butylaminophenyl)methane
bis(p-dimethylaminophenyl)(p-sec. butylethylaminophenyl)methane
bis(p-dimethylaminophenyl)(p-chlorophenyl)methane
bis(p-dimethylaminophenyl)(p-diethylaminophenyl)methane
bis(p-dimethylaminophenyl)(4-dimethylamino-1-naphthyl)methane
bis(p-dimethylaminophenyl)(6-dimethylamino-m-tolyl)methane
bis(p-dimethylaminophenyl)(4-dimethylamino-o-tolyl)methane
bis(p-dimethylaminophenyl)(4-ethylamino-1-naphthyl)methane
bis(p-dimethylaminophenyl)(p-hexyloxyphenyl)methane
bis(p-dimethylaminophenyl)(p-methoxyphenyl)methane
bis(p-dimethylaminophenyl)(5-methyl-2-pyridyl)methane
bis(p-dimethylaminophenyl)2-quinolymethane
bis(p-dimethylaminophenyl)o-tolylmethane
bis(p-dimethylaminophenyl)(1,3,3-trimethyl-2-indolinylidenemethyl)methane
bis(4-dimethylamino-o-tolyl)(p-aminophenyl)methane
bis(4-dimethylamino-o-tolyl)(o-bromophenyl)methane
bis(4-dimethylamino-o-tolyl)(o-cyanophenyl)methane
bis(4-dimethylamino-o-tolyl)(o-fluorophenyl)methane
bis(4-dimethylamino-o-tolyl)1-naphthylmethane
bis(4-dimethylamino-o-tolyl)phenylmethane
bis(p-ethylaminophenyl)(o-chlorophenyl)methane
bis(4-ethylamino-m-tolyl)(o-methoxyphenyl)methane
bis(4-ethylamino-m-tolyl)(p-methoxyphenyl)methane
bis(4-ethylamino-m-tolyl)(p-dimethylaminophenyl)methane
bis(4-ethylamino-m-tolyl)(p-hydroxyphenyl)methane
bis[4-ethyl(2-hydroxyethyl)amino-m-tolyl](p-diethyl aminophenyl)methane
bis[p-(2-hydroxyethyl)aminophenyl](o-chlorophenyl)methane
bis[p-(bis(2-hydroxyethyl)aminophenyl)](4-diethylamino-o-tolyl)methane
bis[p-(2-methoxyethyl)aminophenyl]phenylmethane
bis(p-methylaminophenyl)(o-hydroxyphenyl)methane
bis(p-propylaminophenyl)(m-bromophenyl)methane
tris(4-amino-o-tolyl)methane
tris(4-anilino-o-tolyl)methane
tris(p-benzylaminophenyl)methane
tris[4-bis(2-cyanoethyl)amino-o-tolyl]methane
tris[p-(2-cyanoethyl)ethylaminophenyl]methane
tris(p-dibutylaminophenyl)methane
tris(p-di-n-butylaminophenyl)methane
tris(4-diethylamino-2-chlorophenyl)methane
tris(p-diethylaminophenyl)methane
tris(4-diethylamino-o-tolyl)methane
tris(p-dihexylamino-o-tolyl)methane
tris(4-dimethylamino-o-tolyl)methane
tris(p-hexylaminophenyl)methane
tris[p-bis(2-hydroxyethyl)aminophenyl]methane
tris(p-methylaminophenyl)methane
tris(p-dioctadecylaminophenyl)methane
tris(4-diethylamino-2-fluorophenyl)methane
tris(4-dimethylamino-2-fluorophenyl)methane
bis(2-bromo-4-diethylaminophenyl)phenylmethane
bis(2-butoxy-4-diethylaminophenyl)phenylmethane
bis(4-diethylamino-o-tolyl)(p-methoxyphenyl)methane
bis(4-diethylamino-2-methoxyphenyl)(p-nitrophenyl)methane
bis(4-diethylamino-1-naphthyl)(4-diethylamino-o-tolyl)methane
bis(4-diethylamino-o-tolyl)1-naphthylmethane
bis(4-diethylamino-o-tolyl)phenylmethane tris(4-dimethylamino-2-chlorophenyl)methane
bis(4-dimethylamino-2,5-dimethylphenyl)phenylmethane
bis(4-dimethylamino-o-tolyl)(o-bromophenyl)methane
bis(4-ethylbenzylamino-o-tolyl)(p-methoxyphenyl)methane
tris(p-dioctylamino-o-tolyl)methane
bis(4-diethylamino-o-tolyl)-4-methoxy-1-naphthylmethane
bis(4-diethylamino-o-tolyl)-3,4,5-trimethoxyphenylmethane
bis(4-diethylamino-o-tolyl)-p-hydroxyphenylmethane
5-[bis(4-diethylamino-o-tolyl)methyl]-2,3-cresotic acid
4-[bis(4-diethylamino-o-tolyl)-methyl]-phenol
4-bis(4-diethylamino-o-tolyl)-methyl]-acetanilide
4-bis(4-diethylamino-o-tolyl)-methyl]-phenylacetate
4-[bis(4-diethylamino-o-tolyl)-methyl]-benzoic acid
4-[bis(4-diethylamino-o-tolyl)-methyl]-diphenyl sulfone
4-[bis(4-diethylamino-o-tolyl)-methyl]-phenylmethyl sulfone
4-[bis(4-diethylamino-o-tolyl)methyl]-methylsulfonanilide
4-[bis(4-diethylamino-o-tolyl)-methyl]-p-tolylsulfonanilide
bis(4-diethylamino-o-tolyl)-p-nitrophenyl methane
bis(4-diethylamino-o-tolyl)(2-diethylamino-4-methyl-5-thiazolyl)methane
bis(4-diethylamino-o-tolyl)(2-diethylamino-5-methyl-6-benzoxazolyl)methane
bis(4-diethylamino-o-tolyl)(2-diethylamino-5-methyl-6-benzothiazolyl)methane
bis(4-diethylamino-o-tolyl)(1-ethyl-2-methyl-3-indolyl)methane
bis(4-diethylamino-o-tolyl)(1-benzyl-2-methyl-3-indolyl)methane
bis(4-diethylamino-o-tolyl)(1-ethyl-2-methyl-5-methoxyl-3-indolyl)methane
bis(1-o-xylyl-2-methyl-3-indolyl)(4-diethylamino-o-tolyl)methane
bis(4-diethylamino-o-tolyl)(1-ethyl-5-indolinyl)methane
bis(1-isobutyl-6-methyl-5-indololinyl)(4-diethylamino-o-tolyl)methane
bis(4-diethylamino-o-tolyl)(8-methyl-9-julolindinyl)methane
bis(4-diethylamino-2-acetamidophenyl)(4-diethylamino-o-tolyl)methane
4-[bis(4-diethylamino-o-tolyl)methyl]-N-ethylacetanilide
bis[4-(1-phenyl-2,3-dimethyl-5-pyrazolinyl)](4-diethylamino-o-tolyl)methane
bis(4-diethylamino-o-tolyl)(7-diethylamino-4-methyl-3-coumarinyl)methane
bis(4-diethylamino-o-tolyl)(4-acrylamidophenyl)methane
bis(4-diethylamino-o-tolyl)(p-benzylthiophenyl)methane
bis(4-diethylamino-o-tolyl)(4-isopropylthio-3-methylphenyl)methane
bis(4-diethylamino-o-tolyl)(4-chlorobenzylthiophenyl)methane
bis(4-diethylamino-o-tolyl)(2-furyl)methane
bis(4-diethylamino-o-tolyl)(3,4-methylenedioxyphenyl)methane
bis(4-diethylamino-o-tolyl)(3,4-dimethoxyphenyl)methane
bis(4-diethylamino-o-tolyl)(3-methyl-2-thienyl)methane
bis(4-diethylamino-o-tolyl)(2,4-dimethoxyphenyl)methane In addition to the above enumerated aminotriarylmethanes there can be employed leucatriphenylmethane dyes bearing CI numbers 42000B, 42005, 42010, 42025, 42030, 42035, 42036, 42040, 42500, 42505, 42510B, 42515, 52520, 42555B, 42556, 42563B, 42600, 42605, 42705, 42760, 42785, 43500.

(b) Aminoxanthenes 3-amino-6-dimethylamino-2-methyl-9-(o-chlorophenyl)xanthene
3-amino-6-dimethylamino-2-methyl-9-phenylxanthene
3-amino-6-dimethylamino-2-methylxanthene
3,6-bis(diethylamino)-9-(o-chlorophenyl)xanthene
3,6-bis(diethylamino)-9-hexylxanthene
3,6-bis(diethylamino)-9-(o-methoxycarbonylphenyl)xanthene
3,6-bis(diethylamino)-9-methylxanthene
3,6-bis(diethylamino)-9-phenylxanthene
3,6-bis(diethylamino)-9-o-tolylxanthene
3,6-bis(dimethylamino)-9-(o-chlorophenyl)xanthene
3,6-bis(dimethylamino)-9-ethylxanthene
3,6-bis(dimethylamino)-9-(o-methoxycarbonylphenyl)xanthene
3,6-bis(dimethylamino)-9-methylxanthene In addition to the above enumerated aminoxanthenes there can be employed leuco forms of xanthene dyes bearing CI Numbers 45000, 45005, 45010, 45015, 45050, 45070, 45090, 45095, 45100, 45105, 45150.

(c) Aminothioxanthenes 3,6-bis(diethylamino)-9-(o-ethoxycarbonylphenyl)thioxanthene
3,6-bis(dimethylamino)-9-(o-methoxycarbonylphenyl)-thioxanthene
3,6-bis(dimethylamino)thioxanthene
3,6-dianilino-9-(o-ethoxycarbonylphenyl)thioxanthene (d) Amino-9,10-dihydroacridines 3,6-bis(benzylamino)-9,10-dihydro-9-methylacridine
3,6-bis(diethylamino)-9-hexyl-9,10-dihydroacridine
3,6-bis(diethylamino)-9,10-dihydro-9-methylacridine
3,6-bis(diethylamine)-9,10-dihydro-9-phenylacridine
3,6-diamino-9-hexyl-9,10-dihydroacridine
3,6-diamino-9,10-dihydro-9-methylacridine
3,6-diamino-9,10-dihydro-9-phenylacridine
3,6-bis(dimethylamino)-9-hexyl-9,10-dihydroacridine
3,6-bis(dimethylamino)-9,10-dihydro-9-methylacridine.

In addition thereto there can also be enumerated the leuco forms of acridine dyes bearing CI numbers 46000, 46005B, 46010, 46015, 46020, 46025, 46030, 36035, 36040, 46055, 46060, 46065, 46070, 46075, 46080.

(e) Aminophenoxazines 3,7-bis(diethylamino)phenoxazine
9-dimethylamino-benzo[a]phenoxazine and leuco forms of phenoxazine dyes bearing CI numbers 51000, 51180, 51185, 51190, and 51195 (for instance, 5-benzylamino-9-diethylamino-benzo[a]phenoxadine)

(f) Aminophenothiazines 3,7-bis(benzylamino)phenothiazine and leuco forms of phenothiazine dyes bearing CI numbers 52000, 52010, 52015, 52020, 52025, 52030, 52035, 52050 (for instance, 3,7-bis(dimethylamino)-4-nitrophenothiazine, 3,7-bis[N-ethyl-N(m-sulfobenzyl)amino]phenothiazine, monosodium salt, 3-7-diaminophenothiazine)

(g) Aminodihydrophenazines 3,7-bis(benzylethylamino)-5,1-dihydro-5-phenylphenazine
3,7-bis(diethylamino)-5-hexyl-5,10-dihydrophenazine
3,7-bis(dihexylamino)-5,10-dihydrophenazine
3,7-bis(dimethylamino)-5-(p-chlorophenyl)-5,10-dihydrophenazine
3,7-diamino-5-(o-chlorophenyl)-5,10-dihydrophenazine
3,7-diamino-5,10-dihydrophenazine
3,7-diamino-5,10-dihydro-5-methylphenazine
3,7-diamino-5-hexyl-5,10-dihydrophenazine
3,7-bis(dimethylamino)-5,10-dihydrophenazine
3,7-bis(dimethylamino)-5,10-dihydro-5-phenylphenazine
3,7-bis(dimethylamino)-5,10-dihydro-5-methylphenazine In addition thereto there can be enumerated leuco forms of phenazine dyes bearing CI numbers 50035, 50040, 50045, 50200, 50205, 50206, 50210, 50216, 50220, 50225, 20235, 50240.

(h) Aminodiphenylmethanes 1,4-bis[bis-p(diethylaminophenyl)methyl]piperazine
bis(p-diethylaminophenyl)anilinomethane
bis(p-diethylaminophenyl)-1-benzotriazolylmethane
bis(p-diethylaminophenyl)-2-benzotriazolylmethane
bis(p-diethylaminophenyl) (p-cloroanilino)methane
bis(p-diethylaminophenyl) (2,4-dichloroanilino)methane
bis(p-diethylaminophenyl) (methylamino)methane
bis(p-diethylaminophenyl) (octadecylamino)methane
bis(p-dimethylaminophenyl)aminomethane
bis(p-dimethylaminophenyl)anilinomethane
1,1-bis(dimethylaminophenyl)ethane
1,1-bis(dimethylaminophenyl)heptane
bis(4-methylamino-m-tolyl)aminoethane.

(i) Leuco indoamines 4-amino-4'-dimethylaminodiphenylamine
p-(p-dimethylaminoanilino)phenol and leuco forms of indoamine and indophenol dyes bearing CI numbers 49400, 49405, 49410, 49700.

(j) Aminohydrocinnamic acids (cyanoethanes, leucomethines)

4-amino-α,β-dicyanohydrocinnamic acid, methyl ester
4-anilino-α,β-dicyanohydrocinnamic acid, methyl ester
4-(p-chloroanilino)-α,β-dicyanohydrocinnamic acid, methyl ester
α-cyano-4-dimethylaminohydrocinnamide
α-cyano-4-dimethylaminohydrocinnamic acid, methyl ester
α,β-dicyano-4-diethylaminohydrocinnamic acid, methyl ester
α,β-dicyano-4-dimethylaminohydrocinnamide
α,β-dicyano-4-dimethylaminohydrocinnamic acid, methyl ester
α,β-dicyano-4-dimethylaminohydrocinnamic acid
α,β-dicyano-4-dimethylaminohydrocinnamic acid, hexyl ester
α,β-dicyano-4-ethylaminohydrocinnamic acid, methyl ester
α,β-dicyano-4-hexylaminohydrocinnamic acid, methyl ester
α,β-dicyano-4-methylaminocinnamic acid, methyl ester
p-(2,2-dicyanoethyl)-N,N-dimethylaniline
4-methoxy-4'-(1,2,2-tricyanoethyl)azobenzene
4-(1,2,2-tricyanoethyl)azobenzene
P-(1,2,2-tricyanoethyl)-N,N-dimethylaniline and substituted hydrocinnamic acids, namely leuco-pigments comprising dyes bearing CI numbers 48000, 48001, and 48005.

(k) Hydrazines 1-(p-diethylaminophenyl)-2-(2-pyridyl)hydrazine
1-(p-dimethylaminophenyl)-2-(2-pyridyl)hydrazine
1-(3-methyl-2-benzothiazolyl)-2-(4-hydroxy-1-naphthyl)hydrazine
1-(2-naphthyl)-2-phenylhydrazine
1-p-nitrophenyl-2-phenylhydrazine
1-(1,3,3-trimethyl-2-indolinyl)-2-(3-phenylcarbamoyl-4-hydroxy-1-naphthyl)hydrazine (l) Leuco indigoid dyes The leuco forms of indigoid dyes having CI numbers 73000, 73015, 73025, 73030, 73035, 73040, 73045, 73050, 73055, 73060, 73065, 73070, 73085, 73090, 73110, 73300, 73305, 73310, 73315, 73320, 73325, 73335, 73340, 73345, 73350, 73360.

(m) Amino-2,3-dihydroanthraquinones 1,4-dianilino-2,3-dihydroanthraquinone
1,4-bis(ethylamino)-2,3-dihydroanthraquinone and leuco forms of dyes bearing CI numbers 61100, 61105, 61107, 61116, 61120, 61140, 61500, 61505, 61510, 61515, 61520, 61525, 61530, 61535, 61540, 61545, 61565, 61650 [for instance, 1-amino-4-methoxyanilino-2,3-dihydroanthraquinone, 1-p-(2-hydroxyethylamino)anilino-4-methylamino-2,3-dihydroanthraquinone].

(n) Phenethylanilines

N-(2-cyanoethyl)-p-phenethylaniline
N,N-diethyl-p-phenylethylaniline
N,N-dimethyl-p-[2-(1-naphthyl)ethyl]aniline
N,N-dimethyl-p-[2-(4-nitro-1-naphthyl)ethyl]aniline
N,N-dimethyl-p-phenethylaniline
N,N-dimethyl-p-[2-(4-methoxy-1-naphthyl)ethyl]aniline
p-(p-methoxyphenethy)aniline
p-[2-1-naphthyl)ethyl]aniline
p-(p-nitrophenethyl)aniline
p-phenethylaniline An acid is needed for enhancing color generation. In other words, most color-generators perform best when an acid is present. Color-generators which contain amino radicals can bind the acid by salt formation. The quantity of acid used is suitably in the range of 1–10 moles per mole of each color-generator.

As the concrete examples of said acids there can be enumerated organic and inorganic acids such as maleic acid, p-toluene sulfonic acid, hydrochloric acid, hydrobromic acid, nitric acid, phosphoric acid and additionally Lewis acids such as zinc chloride, zinc bromide, ferric chloride and the like.

The cobalt complexes used in the present invention (in particular, it is preferable to use cobalt (III) complex substances), when heated, are subjected to reduction so as to produce basic substances such as ammonia, amine, etc., thereby accelerating the speed of fixing reaction, i.e., the fixing sensitivity. As typical examples of said complexes can be enumerated the following compounds:

(1) hexa-ammine cobalt (III) perchlorate
(2) hexa-ammine cobalt (III) acetate
(3) hexa-ammine cobalt (III) thiocyanate
(4) hexa-ammine cobalt (III) trifluoroacetate
(5) hexa-ammine cobalt (III) benzirate
(6) chloropenta-ammine cobalt (III) bromide
(7) chloropenta-ammine cobalt (III) perchlorate
(8) bromopenta-ammine cobalt (III) bromide
(9) bromopenta-amine cobalt (III) perchlorate
(10) aquopenta-ammine cobalt (III) nitrate
(11) aquopenta-ammine cobalt (III) perchlorate
(12) bis(ethylenediamine)di-ammine cobalt (III) perchlorate
(13) bis(ethylenediamine)diazido cobalt (III) perchlorate
(14) bis(ethylenediamine)diacetate cobalt (III) chloride
(15) bis(ethylenediamine)diacetate cobalt (III) trifluoroacetate
(16) triethylenetetradichloro cobalt (III) acetate
(17) triethylenetetraamine dichloro cobalt (III) trifluoroacetate
(18) bis(methylamine)tetra-ammine cobalt (III) hexafluorophosphate
(19) aquopenta(methylamine) cobalt (III) nitrate
(20) chloropenta(ethylamine) cobalt (III) chloride
(21) chloropenta(ethylamine) cobalt (III) perfluorobutanoate
(22)trinitrotris-amine cobalt (III)
(23) trinitrotris(methylamine) cobalt (III)
(24) tris(ethylenediamine) cobalt (III) acetate
(25) tris(ethylenediamine) cobalt (III) perchlorate
(26) tris(1,3propanediamine) cobalt (III) trifluoroacetate
(27) bis(dimethylglyoxime)bispyridine cobalt (III) trichloroacetate
(28) N,N'-ethylenebis(salicylideneimine)bisammine cobalt (III) bromide
(29) N,N'-ethylenebis(salicylideneimine)bisammine cobalt (III) perchlorate
(30) bis(dimethylglyoxime)ethylaquo cobalt (III)
(31) $\mu$-superoxodeca-ammine dicobalt (III) perchlorate
(32) sodium dichloro ethylenediaminediaceto cobalt (III)
(33) penta-ammine carbonate cobalt (III) nitrite
(34) penta-ammine carbonato cobalt (III) perchlorate
(35) tris(glycinato) cobalt (III)
(36) trans[bis(ethylenediamine)chlorothiocyanato cobalt (III)]sulfite
(37) trans[bis(ethylenediamine)chlorothiocyanato cobalt (III)]perchlorate
(38) trans[bis(ethylenediamine)diazido cobalt (III)]chloride
(39) trans[bis(ethylenediamine)diazido cobalt (III)]thiocyanato
(40) cis[bis(ethylenediamine)ammine diazido cobalt (III)]trifluoroacetate
(41) tris(ethylenediamine) cobalt (III) chloride
(42) tris(ethylenediamine) cobalt (III) benzilate
(43) trans[bis(ethylenediamine)dichloro salt (III)]chloride
(44) trans[bis(ethylenediamine)dichloro cobalt (III)]-perchlorate
(45) bis(ethylenediamine)dithiocyanato cobalt (III) fluoride
(46) bis(ethylenediamine)dithiocyanato cobalt (III) perfluorobenzoate
(47) triethylenetetramine dinitro cobalt (III) iodide
(48) triethylenetetramine dinitro cobalt (III) dichloroacetate
(49) tris(ethylenediamine) cobalt (III) 2-pyridylcarboxylate
(50) tris(ethylenediamine) cobalt (III) salicylate
(51) tris(2,2'-dipyridyl) cobalt (III) perchlorate
(52) bis(dimethylglyoxime) (chloropyridime) cobalt (III)
(53) bis(dimethylglyoxime)thiocyanatopyridine cobalt (III)

Further, the photoreductants suitably used in the present invention, when irradiated with visible light, produced reducing substances in the presence of hydrogen donators, which, when heated, are capable of instantaneously reducing the cobalt (III) complex compounds. As the typical examples of aforegoing photoreductants can be enumerated quinone, disulfide, diazo anthrone, diazonium salt, diazo phenanthrone, aromatic azide, acyloin, aromatic ketone, aromatic carbazide, aromatic diazo sulfonate, etc. Above all, those capable of exhibiting strong absorption to the visible region are preferably used in the present invention.

The specific, exemplary disulfide, diazo anthrone, diazo phenanthrone, aromatic carbazide, aromatic azide, diazonium salt, and aromatic sulfonate will be given below:

(1) 1-naphthyl disulfide
(2) $\beta$-naphthyl disulfide
(3) 9-anthryl disulfide
(4) cyclohexyl 2-naphthyl disulfide
(5) diphenylmethyl 2-naphthyl disulfide
(6) 2-dodecyl 1'-naphthyl disulfide
(7) thioctic acid
(8) 2,2'-bis(hydroxymethyl)diphenyl disulfide
(9) 10-diazoanthrone
(10) 2-methoxy-10-diazoanthrone
(11) 3-nitro-10-diazoanthrone
(12) 3,6-diethoxy-10-diazoanthrone
(13) 3-chloro-10-diazoanthrone
(14) 4-ethoxy-10-diazoanthrone
(15) 4-(1-hydroxyethyl)-10-diazoanthrone
(16) 2,7-diethyl-10-diazoanthrone
(17) 9-diazo-10-phenanthrone
(18) 3,6-dimethyl-9-diazo-10-phenanthrone
(19) 2,7-dimethyl-9-diazo-10-phenanthrone
(20) 4-azidobenzoic acid
(21) 4-nitrophenyl azide
(22) 4-dimethylaminophenyl azide
(23) 2,6-di-4-azidobenzylidene-4-methylcyclohexanone
(24) 2-azido-1-octylcarbamoyl-benzimidazole
(25) 2,5-bis(4-azidophenyl)-1,3,4-oxadiazole
(26) 1-azido-4-methoxynaphthalene
(27) 2-carbazido-1-naphthol
(28) benzophenone
(29) 2-nitrobenzophenone
(30) diaminobenzophenone
(31) phthalophenone
(32) phenyl(1-methoxybenzyl)ketone
(33) phenyl-1-(1-phenoxy)benzylketone

(34) phenyl-1-(2-chlorophenoxy)benzylketone
(35) phenyl-1-(4-chlorophenoxy)benzylketone
(36) phenyl-1-(2-bromophenoxy)benzylketone
(37) phenyl-1-(2-iodinephenoxy)benzylketone
(38) phenyl-1-(4-phenoxy)benzylketone
(39) phenyl-1-(4-benzylphenoxy)benzylketone
(40) 4-(diamylamino)benzenediazonium tetrafluoroborate
(41) 2-methyl-4-diethylaminobenzenediazonium tetrafluoroborate
(42) 4-(oxazolidino)benzenediazonium tetrafluoroborate
(43) 4-(cyclohexylamino)benzenediazonium tetrafluoroborate
(44) 2-nitro-4-morpholinobenzenediazonium hexafluorophosphate
(45) 4-(9-carbazolyl)benzenediazonium hexafluorophosphate
(46) 4-(dihydroxyethylamino)-3-methylbenzenediazonium hexafluorophosphate
(47) 4-diethylaminobenzenediazonium hexachlorostannate
(48) 4-dimethylamino-3-methylbenzenediazonium hexachlorostannate
(49) 2-methyl-4-(N-methyl-N-hydroxypropylamino)-benzenediazonium hexachlorostannate
(50) 4-dimethylaminobenzenediazonium tetrachlorozincate
(51) 4-dimethylamino-3-ethoxybenzenediazonium chlorozincate
(52) 4-diethylaminobenzenediazonium tetrachlorozincate
(53) 4-diethylaminobenzenediazonium hexafluorophosphate
(54) 2-carboxy-4-dimethylaminobenzenediazonium hexafluorophosphate
(55) 3-(2-hydroxyethoxy)-4-pyrrolidinobenzenediazonium hexafluorophosphate
(56) 4-methoxybenzenediazonium hexafluorophosphate
(57) 2,5-diethoxy-4-acetamidobenzenediazonium hexafluorophosphate
(58) 4-methylamino-3-ethoxy-6-chlorobenzenediazonium hexafluorophosphate
(59) 3-methoxy-4-diethylaminobenzenediazonium hexafluorophosphate
(60) di(1-naphthyl)acyloin
(61) di(2-naphthyl)acyloin
(62) benzoin
(63) benzoin acetate
(64) benzoin methylether
(65) benzoin phenylether
(66) benzoin 2-bromophenylether
(67) benzoin 4-chlorophenylether
(68) benzoin 4-phenoxyphenyl ether
(69) benzoin 4-benzoylphenyl ether
(70) benzoin 2-iodinephenyl ether
(71) benzoin 2-chlorophenyl ether
(72) 2-phenylbenzoin
(73) 2-(1-naphthol)benzoin
(74) 2-n-butylbenzoin
(75) 2-hydroxymethyl benzoin
(76) 2-(2-cyanomethyl)benzoin
(77) 2-(5-benzinyl)benzoin
(78) potassium 4-(N-ethyl-N-hydroxyethylamino)-benzenediazosulfonate
(79) sodium 4-(diethylamino)benzenediazosulfonate
(80) potassium 2-chloro-4-morpholinobenzenediazosulfonate
(81) tetramethylammonium 3-methoxy-4-piperidinobenzenediazosulfonate In addition to the above mentioned substances, those obtained by subjecting the under mentioned amino compounds to diazotization may also be employed effectively as diazonium salts in the present invention. As the counter ions therefor there may be enumerated $Cl^-$, $ZnCl^-$, $SO_4^{2-}$, $BF_4^-$, $CF_3COO^-$, etc.

p-(p-tolylthio)aniline
2,4,5-trimethoxyaniline
5-amino-2-diethylamino-p-anisic acid, methyl ester
4-(p-tolylthio)o-ansidine
4-(4-amino-3-butylphenyl)morpholine
4-(4-amino-2,5-diethoxyphenyl)morpholine
4-(4-amino-2,5-dibutoxyphenyl)morpholine
4-(p-aminophenyl)morpholine
4-amino-1-naphthol
4-amino-7-methoxy-3-methyl-1-naphthol
4-amino-3-methyl-1-naphthol
$N^2$, $N^2$-dimethyl-1,2-naphthalenediamine
N,N-diethyl-1,4-naphthalenediamine
2-methyl-$N^1$-phenyl-1,4-naphthalenediamine
4-amino-2,6-dimethoxyphenyl
$N^1$, $N^1$-diethyl-4-methyl-m-phenylenediamine
4-methoxy-$N^3$,$N^3$-dimethyl-m-phenylenediamine
N,N-diethyl-o-phenylenediamine
$N^1$, $N^1$-diethyl-4-methyl-o-phenylenediamine
N-methyl-N-phenyl-o-phenylenediamine
p-phenylenediamine
2-chloro-5-methoxy-$N^1$,$N^1$-dimethyl-p-phenylenediamine
$N^1$-cyclohexyl-2-methoxy-p-phenylenediamine
2,5-butoxy-N,N-diethyl-p-phenylenediamine
2,5-diethoxy-N,N-dimethyl-p-phenylenediamine
N,N-diethyl-p-phenylenediamine
2,5-dimethoxy-N-phenyl-p-phenylenediamine
N,N-dimethyl-p-phenylenediamine
N-(2-hydroxyethyl)-N-ethyl p-phenylenediamine
N-(p-methoxyphenyl)p-phenylenediamine
N-phenyl-p-phenylenediamine
2-phenyl-$N^4$,$N^4$-dimethyl-p-phenylenediamine
1-(p-aminophenyl)piperidine
1-(p-aminophenyl)pyrrolidine
$N^2$,$N^2$-dimethyltoluene-2,5-diamine
4-amino-2,6-xylenol.

As previously stated, quinones can be effectively used as photoreductants. And the quinones preferably used in the present invention include O- or p-benzoquinone, O- or p-naphthoquinone, phenanthrenequinone and anthraquinone. These quinones can be divided into the external hydrogen source type quinones which produce reducing agents in the manner of drawing their hydrogen sources (active hydrogen atoms) out of different compounds (hydrogen donators) and the internal hydrogen source type quinones which include the hydrogen sources of their own. The internal hydrogen source type quinones per se can exhibit a photoreducing property with ease but with little efficiency. Therefore, it is preferable that they should be used in combination with the hydrogen donators.

As the concrete examples of the aforesaid external hydrogen source type quinones there can be enumerated the following substances:

(1) 2,5-dimethyl-1,4-benzoquinone (2) 2,6-dimethyl-1,4-benzoquinone
(3) duroquinone
(4) 2-(1-formyl-1-methylethyl)-5-methyl-1,4-benzoquinone
(5) 2-methyl-1,4-benzoquinone
(6) 2-phenyl-1,4-benzoquinone
(7) 2,5-dimethyl-6-(1-formylethyl)-1,4-benzoquinone
(8) 2-(2-cyclohexanonyl)-3,6-dimethyl-1,4-benzoquinone
(9) 1,4-naphthoquinone
(10) 2-methyl-1,4-naphthoquinone
(11) 2,3-dimethyl-1,4-naphthoquinone
(12) 2,3-dichloro-1,4-naphthoquinone
(13) 2-thiomethyl-1,4-naphthoquinone
(14) 2-(1-formyl-2-propyl)-1,4-naphthoquinone
(15) 2-(2-benzoylethyl)-1,4-naphthoquinone
(16) 9,10-phenanthrenequinone
(17) 2-tert-butyl-9,10-anthraquinone
(18) 2-methyl-1,4-anthraquinone
(19) 2-methyl-9,10-anthraquinone
(20) 1,8-pyrenequinone
(21) 1,6-pyrenequinone On the other hand, as the concrete examples of the aforesaid internal hydrogen source type quinones there can be enumerated the following substances:

(1) 5,8-dihydro-1,4-naphthoquinone
(2) 5,8-dihydro-2,5,8-trimethyl-1,4-naphthoquinone
(3) 2,5-bis(dimethylamino)-1,4-benzoquinone
(4) 2,5-dimethyl-3,6-bis(dimethylamino)-1,4-benzoquinone
(5) 2,5-dimethyl-3,6-bispyrrolidino-1,4-benzoquinone
(6) 2-ethoxy-5-methyl-1,4-benzoquinone
(7) 2,6-dimethoxy-1,4benzoquinone
(8) 2,5-dimethoxy-1,4-benzoquinone
(9) 2,6-diethoxy-1,4-benzoquinone
(10) 2,5-diethoxy-1,4-benzoquinone
(11) 2,5-bis(2-methoxyethoxy)-1,4-benzoquinone
(12) 2,5-bis(β-phenoxyethoxy)-1,4-benzoquinone
(13) 2,5-diphenethoxy-1,4-benzoquinone
(14) 2,5-di-n-propoxy-1,4-benzoquinone
(15) 2,5-di-isopropoxy-1,4-benzoquinone
(16) 2,5-di-n-butoxy-1,4-benzoquinone
(17) 2,5-di-sec-butoxy-1,4-benzoquinone
(18) 1,1'-bis(5-methyl-1,4-benzoquinone-2-yl)-diethyl ether
(19) 2-methyl-5-morpholinomethyl-1,4-benzoquinone
(20) 2,3,5-trimethyl-6-morpholinomethyl-1,4-benzoquinone
(21) 2,5-bis(morpholinomethyl)-1,4-benzoquinone
(22) 2-hydroxymethyl-3,5,6-trimethyl-1,4-benzoquinone
(23) 2-(1-hydroxyethyl)-5-methyl-1,4-benzoquinone
(24) 2-(1-hydroxy-n-propyl)-5-methyl-1,4-benzoquinone
(25) 2-(1-hydroxy-2-methyl-n-propyl)-5-methyl-1,4-benzoquinone
(26) 2-(1,1-dimethyl-2-hydroxyethyl)-5-methyl-1,4-benzoquinone
(27) 2-(1-acetoxyethyl)-5-methyl-1,4-benzoquinone
(28) 2-(1-methoxyethyl)-5-methyl-1,4-benzoquinone
(29) 2-(2-hydroxyethyl)-3,5,6-trimethyl-1,4-benzoquinone
(30) 2-ethoxy-5-phenyl-1,4-benzoquinone
(31) 2-i-propoxy-5-phenyl-1,4-benzoquinone
(32) 1,4-dihydro-1,4-dimethyl-9,10-anthraquinone
(33) 2-dimethylamino-1,4-naphthoquinone
(34) 2-methoxy-1,4-naphthoquinone
(35) 2-benzyloxy-1,4-naphthoquinone
(36) 2-methoxy-3-chloro-1,4-naphthoquinone
(37) 2,3-dimethoxy-1,4-naphthoquinone
(38) 2,3-diethoxy-1,4-naphthoquinone
(39) 2-ethoxy-1,4-naphthoquinone
(40) 2-phenethoxy-1,4-naphtoquinone
(41) 2-(2-methoxyethoxy)-1,4-naphthoquinone
(42) 2-(2-ethoxyethoxy)-1,4-naphthoquinone
(43) 2-(2-phenoxy)ethoxy-1,4-naphthoquinone
(44) 2-ethoxy-5-methoxy-1,4-naphthoquinone
(45) 2-ethoxy-6-methoxy-1,4-naphthoquinone
(46) 2-ethoxy-7-methoxy-1,4-naphthoquinone
(47) 2-n-propoxy-1,4-naphthoquinone
(48) 2-(3-hydroxypropoxy)-1,4-naphthoquinone
(49) 2-isopropoxy-1,4-naphthoquinone
(50) 7-methoxy-2-isopropoxy-1,4-naphthoquinone
(51) 2-n-butoxy-1,4-naphthoquinone
(52) 2-sec-butoxy-1,4-naphthoquinone
(53) 2-n-pentoxy-1,4-naphthoquinone
(54) 2-n-hexoxy-1,4-naphthoquinone
(55) 2-n-heptoxy-1,4-naphthoquinone
(56) 2-acetoxymethyl-3-methyl-1,4-naphthoquinone
(57) 2-methoxymethyl-3-methyl-1,4-naphthoquinone
(58) 2-(β-acetoxyethyl)-1,4-naphthoquinone
(59) 2-N,N-bis-(cyanomethyl)aminomethyl-3-methyl-1,4-naphthoquinone
(60) 2-methyl-3-morpholinomethyl-1,4-naphthoquinone
(61) 2-hydroxymethyl-1,4-naphthoquinone
(62) 2-hydroxymethyl-3-methyl-1,4-naphthoquinone
(63) 2-(1-hydroxyethyl)-1,4-naphthoquinone
(64) 2-(2-hydroxyethyl)-1,4-naphthoquinone
(65) 2-(1,1-dimethyl-2-hydroxyethyl)-1,4-naphthoquinone
(66) 2-bromo-3-isopropoxy-1,4-naphthoquinone
(67) 2-ethoxy-3-methyl-1,4-naphthoquinone
(68) 2-chloro-3-piperidino-1,4-naphthoquinone
(69) 2-morpholino-1,4-naphthoquinone
(70) 2,3-dipiperidino-1,4-naphthoquinone
(71) 2-dibenzylamino-3-chloro-1,4-naphthoquinone
(72) 2-methyloxycarbonylmethoxy-1,4-naphthoquinone
(73) 2-(N-ethyl-N-benzylamino)-3-chloro-1,4-naphthoquinone
(74) 2-morpholino-3-chloro-1,4-naphthoquinone
(75) 2-pyrrolidino-3-chloro-1,4-naphthoquinone
(76) 2-diethylamino-3-chloro-1,4-naphthoquinone
(77) 2-diethylamino-1,4-naphthoquinone
(78) 2-piperidino-1,4-naphthoquinone
(79) 2-pyrrolidino-1,4-naphthoquinone
(80) 2-(2-hexyloxy)-1,4-naphthoquinone
(81) 2-neo-pentyloxy-1,4-naphthoquinone
(82) 2-(2-n-pentyloxy)-1,4-naphthoquinone
(83) 2-(3-methyl-n-butoxy)-1,4-naphthoquinone
(84) 2-(6-hydroxy-n-hexoxy)-1,4-naphthoquinone
(85) 2-ethoxy-3-chloro-1,4-naphthoquinone
(86) 2-di(phenyl)methoxy-1,4-naphthoquinone
(87) 2-(2-hydroxyethoxy)-3-chloro-1,4-naphthoquinone
(88) 2-methyl-3-(1-hydroxymethyl)ethyl-1,4-naphthoquinone
(89) 2-azetidino-3-chloro-1,4-naphthoquinone
(90) 2-(2-hyroxyethyl)-3-bromo-1,4-naphthoquinone
(91) 2,3-dimorpholino-1,4-naphthoquinone
(92) 2-ethylamino-3-piperidino-1,4-naphthoquinone
(93) 2-ethoxymethyl-1,4-naphthoquinone
(94) 2-phenoxymethyl-1,4-naphthoquinone In addition, 2H-benzimidazoles may be used as photoreductants, which, when irradiated with active radiant ray, produce reducing agents, dihyrobenzimidazoles, in the presence of unstable hydrogen atoms.

As the typical examples of 2H-benzimidazoles there can be enumerated the following substances:

(1) 2,2-dimethyl-2H-benzimidazole
(2) 2,2-diethyl-2H-benzimidazole
(3) 2,2-di-n-hexyl-2H-benzimidazole
(4) spiro(2H-benzimidazole-2,1'-cyclohexan)
(5) dispiro(2H-benzimidazole-2,1'-cyclohexan-4,2'-2H-benzimidazole)
(6) 2,2-benzyl-2H-benzimidazole
(7) 2,2-diphenyl-2H-benzimidazole
(8) 2,2-dimethyl-4-n-butyl-2H-benzimidazole
(9) 2,2-diphenyl-5-n-hexyl-2H-benzimidazole
(10) 2'-methyl spiro(2H-benzimidazole-2,1'-cyclohexan)
(11) 3'-methyl spiro(2H-benzimidazole-2,1'-cyclohexan)
(12) 4'-methyl spiro(2H-benzimidazole-2,1'-cyclohexan)
(13) 2',6'-dimethyl spiro(2H-benzimidazole-2,1'-cyclohexan)
(14) 5-methyl spiro(2H-benzimidazole-2,1'-cyclohexan)
(15) 5,6-dimethyl spiro(2H-benzimidazole-2,1'-cyclohexan)
(16) 5,5''-dimethyl dispiro(2H-benzimidazole-2,1'-cyclohexan-4',2''-2H-benzimidazole)
(17) 5,6,5'',6''-tetramethyl spiro(2H-benzimidazole-2,1'-cyclohexan-4',2''-2H-benzimidazole-2,1'-cyclohexan-4',2''-2H-benzimidazole)
(18) 4-bromo-2,2-dimethyl-2H-benzimidazole
(19) 5-iodine-2,2-dimethyl-2H-benzimidazole
(20) 5-chloro spiro(2H-benzimidazole-2,1'-cyclohexan)
(21) 4-chloro spiro(2H-benzimidazole-2,1'-cyclohexan)
(22) 2,2-diethyl-4-trichloromethyl-2H-benzimidazole
(23) 2,2-diphenyl-4-trifluoromethyl-2H-benzimidazole
(24) 2',3',4',5',6'-pentachloro spiro(2H-benzimidazole-2,1'-cyclohexan)
(25) 5-trifluoromethyl spiro(2H-benzimidazole-2,1'-cyclohexan)
(26) 2,2-dibenzyl-4-methoxy-2H-benzimidazole
(27) 2,2-diethyl-4-isopropoxy-2H-benzimidazole
(28) 2,2-diethyl-5-ethoxy-2H-benzimidazole
(29) 5-methoxy spiro(2H-benzimidazole-2,1'-cyclohexan)
(30) 4-ethoxy spiro(2H-benzimidazole-2,1'-cyclohexan)
(31) 5-isopropoxy spiro(2H-benzimidazole-2,1'-cyclohexan)
(32) 2'-methoxy spiro(2H-benzimidazole-2,1'-cyclohexan)
(33)3'-neopentoxy spiro(2H-benzimidazole-2,1'-cyclohexan)
(34) 4,4'-dimethoxy dispiro(2H-benzimidazole-2,1'-cyclohexan-4',2''-2H-benzimidazole)
(35) 5,5''-diisopropoxy-2'-methoxy dispiro (2H-benzimidazole-2,1'-cyclohexan-4',2''-2H-benzimidazole)
(36) 2,2-dimethyl-4-amino-2H-benzimidazole
(37) 2,2-dimethyl-4-(N,N-dimethylamino)-2H-benzimidazole
(38) 2,2-dimethyl-5-(N-phenylamino)-2H-benzimidazole
(39) 2,2-dimethyl-5-(N-tolylamino)-2H-benzimidazole
(40) 4-(N,N-diphenylamino)spiro(2H-benzimidazole-2,1'-cyclohexan)
(41) 4-(N-phenylamino)spiro(2H-benzimidazole-2,1'-cyclohexan)
(42) 2'-morpholino spiro(2H-benzimidazole-2,1'-cyclohexan)
(43) 2,2-diphenyl-4-pipridino-2H-benzimidazole
(44) 2,2-diphenyl-5-methylazo-2H-benzimidazole
(45) 2'-methylazo spiro(2H-benzimidazole-2,1'-cyclohexan)
(46) 2,2-dimethyl-5-styryl-2H-benzimidazole
(47) 2,2-dimethyl-4-vinyl-2H-benzimidazole
(48) 5-vinyl spiro(2H-benzimidazole-2,1'-cyclohexan)
(49) 2,2-diphenyl-5-nitro-2H-benzimidazole
(50) 5-carbomethoxy spiro(2H-benzimidazole-2,1'-cyclohexan)

And, 1,3-diazabicyclo[3,1,0]hexy-3-en compounds can also be used as photoreductants which, when exposed to active radiant ray and heat, are capable of producing the precursory substances or reducing agents and the reducing agents per se continuously. The exemplary 1,3-biazabicyclo[3,1,0]hexy-3-en compounds can be defined as those represented by the formula

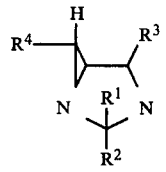

[wherein $R^1$ and $R^2$ are selected from hydrogen, alkyl (including cycloalkyl), aralkyl, alkaryl and aryl substituents; or $R^1$ and $R^2$ couple to form alkylene substituent, preferably 5 or 6 rings; $R^3$ is aryl radical or electron attractive radical such as cyano radical, carboxyl radical, nitro radical or carbonyl-containing radical; and $R^4$ is aryl or allyl radical]

The exemplary 1,3-diazabicyclo[3,1,0]hexy-3-en forms of photoreductants are enumerated as follows:

(1) 4,6-diphenyl-1,3-diazabicyclo[3,1,0]hexy-3-en
(2) 4-phenyl-6-(4-nitrophenyl)-1,3-diazabicyclo[3,1,0]hexy-3-en
(3) 2,4,6-triphenyl-1,3-diazabicyclo[3,1,0]hexy-3-en
(4) 2,4-diphenyl-6-(4-nitrophenyl)-1,3-diazabicyclo[3,1,0]hexy-3-en
(5) 2,2-dicyclopropyl-4-phenyl-6-(4-nitrophenyl)-1,3-diazabicyclo[3,1,0]hexy-3-en
(6) 2,6-diphenyl-4-cyano-1,3-diazabicyclo[3,1,0]hexy-3-en
(7) 2-(1-naphthyl)-4,6-di(chlorophenyl)-1,3-diazabicyclo [3,1,0]hexy-3-en
(8) 2-methyl-4-phenyl-6-(4-nitrophenyl)-1,3-diazabicyclo [3,1,0]hexy-3-en
(9) 2-n-propyl-4-phenyl-6-(4-nitrophenyl)-1,3-diazabicyclo [3,1,0]hexy-3-en
(10) 2-isopropyl-4-phenyl-6-(4-nitrophenyl)-1,3-diazabicyclo [3,1,0]hexy-3-en
(11) 2,2-dimethyl-4,6-diphenyl-1,3-diazabicyclo[3,1,0]hexy-3-en
(12) 2,2-dimethyl-4-phenyl-6-(4-nitrophenyl)-1,3-diazabicyclo [3,1,0]hexy-3-en
(13) 2,2-dimethyl-4-(4-nitrophenyl)-6-phenyl-1,3-diazabicyclo [3,1,0]hexy-3-en
(14) 2,2-dimethyl-4-phenyl-6-(4-cyclophenyl)-1,3-diazabicyclo [3,1,0]hexy-3-en
(15) 2-methyl-2-ethyl-4-phenyl-6-(4-nitrophenyl)-1,3-diazabicyclo[3,1,0]hexy-3-en
(16) 2-methyl-2-n-propyl-4-phenyl-6-(4-nitrophenyl)-1,3-diazabicyclo[3,1,0]hexy-3-en
(17) 2-methyl-2-t-butyl-4-phenyl-6-(4-nitrophenyl)-1,3-diazabicyclo[3,1,0]hexy-3-en

(18) 2,4-diphenyl-2-methyl-6-(4-nitrophenyl)-1,3-diazabicyclo [3,1,0]hexy-3-en
(19) 2,2-dimethyl-4-phenyl-6-(4-nitrophenyl)-1,3-diazabicyclo [3,1,0]hexy-3-en
(20) 2,2-diethyl-4-phenyl-6-(3-nitrophenyl)-1,3-diazabicyclo [3,1,0]hexy-3-en
(21) 2,2-di-n-hexyl-4,6-diphenyl-1,3-diazabicyclo[3,1,0]hexy-3-en
(22) spiro{cyclopentane-1,2'[4'-phenyl-6'-(4-nitrophenyl)-1,3-diazabicyclo[3,1,0]hexy-3-en]}
(23) spiro{cyclohexan-1,2'-[4'-phenyl-6'-(4-nitrophenyl)-1,3-diazabicyclo[3,1,0]hexy-3-en]}
(24) spiro{cycloheptane-1,2'-[4'-phenyl-6'-(4-nitrophenyl)-1,3-diazabicyclo[3,1,0]hexy-3-en]}
(25) spiro{cyclooctane-1,2'-[4'-phenyl-6'-(4-nitrophenyl)-1,3-diazabicyclo[3,1,0]hexy-3-en]}
(26) spiro{1-methylcyclohexan-2,2'-[4'-phenyl-6'-(4-nitrophenyl)-1,3-diazabicyclo[3,1,0]hexy-3-en]}
(27) spiro{1-methylcyclohexan-4,2'-[4'-phenyl-6'-(4-nitrophenyl)-1,3-diazabicyclo[3,1,0]hexy-3-en]}
(28) 2-(4-ethoxycarbonylphenyl)-4,6-diphenyl-1,3-diazabicyclo [3,1,0]hexy-3-en
(29) 2,4-diphenyl-6-(benzoyloxyphenyl)-1,3-diazabicyclo [3,1,0]hexy-3-en
(30) 2,6-di(1-naphthyl)-4-nitro-1,3-diazabicyclo[3,1,0]hexy-3-en
(31) 2,6-di(4-nitrophenyl)-4-phenyl-1,3-diazabicyclo[3,1,0]hexy-3-en
(32) 2,4-diphenyl-6-(3-nitrophenyl)-1,3-diazabicyclo[3,1,0]hexy-3-en
(33) 2,6-diphenyl-4-(4-nitrophenyl)-1,3-diazabicyclo[3,1,0]hexy-3-en
(34) 2-(4-tolyl)-4-phenyl-6-(4-nitrophenyl)-1,3-diazabicyclo[3,1,0]hexy-3-en
(35) 2,6-di(4-tolyl)-4-phenyl-1,3-diazabicyclo[3,1,0]hexy-3-en
(36) 2,4,6-tri(2-aminophenyl)-1,3-diazabicyclo[3,1,0]hexy-3-en
(37) 2-(4-diethylaminophenyl)-4,6-diphenyl-1,3diazabicyclo[3,1,0]hexy-3-en
(38) 2,4-diphenyl-6-(4-morpholinophenyl)-1,3-diazabicyclo[3,1,0]hexy-3-en
(39) 2-benzyl-4-nitro-6-phenyl-1,3-diazabicyclo[3,1,0]hexy-3-en
(40) 2,4-diphenyl-4-nitro-6-phenyl-1,3-diazabicyclo[3,1,0]hexy-3-en
(41) 2,4-diphenyl-6-(4-nitrophenyl)-1,3-diazabicyclo[3,1,0]hexy-3-en
(42) 1-azonia-4,6-diphenyl-1-methyl-3-azabicyclo[3,1,0]hexy-3-en.tetrafluoroborate
(43) 1-azonia-4,6-diphenyl-1,2,2-trimethyl-3-azabicyclo[3,1,0]hexy-3-en.hexafluoroborate
(44) 1-azonia-4-phenyl-6-(4-nitrophenyl)-1,2,2-trimethyl-3-azabicyclo[3,1,0]hexy-3-en.tetrafluoroborate
(45) 1-azonia-4-nitro-2,6-diphenyl-3-azabicyclo[3,1,0]hexy-3-en.chloride
(46) 4,6-diphenyl-1,3-diazabicyclo[3,1,0]hexy-3-en-1-oxide
(47) 2,2-dimethyl-6-(4-nitrophenyl)-4-phenyl-1,3-diazabicyclo[3,1,0]hexy-3-en-1-oxide
(48) spiro{cyclopentane-1,2'-[4'-phenyl-6'-(4-nitrophenyl)-1',3'-diazabicyclo[3,1,0]hexy-3-en-1-oxide]}
(49) spiro{1-methylcyclohexane-4,2'-[2',4',6'-triphenyl-1',3'-diazabicyclo[3,1,0]hexy-3-en-1-oxide]}
(50) spiro{1-cycloheptane-1,2'-[2',2'-dicyclopropyl-4',6'-di(4-nitrophenyl)-1',3'-diazabicycl[3,1,0]hexy-3-en-oxide]}

The hydrogen donators suitably used in the present invention, when exposed to light, supply active hydrogen atoms to photoreductants for converting the latter into reducing substances. The exemplary examples thereof are as follows:

(1) poly(ethylene glycol)
(2) phenyl-1,2-ethanediol
(3) nitrilotriacetonitrile
(4) triethylnitrilotriacetate
(5) poly(vinyl butyral)
(6) poly(vinyl acetal)
(7) 1,4-benzenedimethanol
(8) methyl cellulose
(9) cellulose acetate butyrate
(10) 2,2-bis-(hydroxymethyl)-propionic acid
(11) 1,3-bis-(hydroxymethyl)-urea
(12) 4-nitrobenzyl alcohol
(13) 4-methoxybenzyl alcohol
(14) 2,4-dimethoxybenzyl alcohol
(15) 3,4-dichlorophenylglycol
(16) N-(hydroxymethyl)-benzamide
(17) N-(hydroxymethyl)-phthalimide
(18) 5-(hydroxymethyl)-uracil hemihydrate
(19) nitrilotriacetic acid
(20) 2,2',2''-triethylnitrilotripropionate
(21) 2,2',2''-nitrilotriacetophenone
(22) poly(vinyl acetate)
(23) poly(vinyl alcohol)
(24) ethyl cellulose
(25) carboxymethyl cellulose
(26) poly(vinyl formal)
(27) triethanolamine triacetate
(28)triethanolamine triopropionate
(29) triethanolamine tributyrate
(30) triethanolamine trivalerate The hydrogen donators suitably used in the present invention actually perform plural functions. For instance, the polymers of the above enumerated hydrogen donators also function as binders, and especially the substances such as polyethylene glycol and alcohol, when the fluidity of each element of the composition is enhanced, function as color generating assistants, too.

The composition (color-developing system and/or fixing system) according to the present invention can be added with binders and solvents in addition to the aforegoing components. The binders suitably used in the present invention include a wide variety of natural or synthetic polymers. It is more preferable to use selectively from among them linear film-forming polymers, for instance, such as gelatin; celluloses, for instance, such as ethylcellulose, butylcellulose, cellulose acetate, cellulose triacetate, cellulose butyrate, etc.; vinyl polymers, for instance, such as polyvinyl acetate and polyvinylidene chloride; polyvinylacetals, for instance, such as polyvinylbutyral, poly(vinylchloride-vinylacetate), polystyrene, polybutadiene, polyvinylpyrrolidone, and polymer or copolymer of esters of acrylic acid or methacrylic acid or both; and polyesters, for instance, such as poly(ethylene glycol-isophthalic acid-cyclohexylenebismethanol), poly(p-cyclohexanedicarbonic acid-2,2,4,4-tetramethylcyclobutane-1,3-diol). The condensate of epichlorohydrin and bisphenol is usefully employed as binder, too. In this connection, it should be noted that these binders can also be utilized for the formation of an intermediate layer.

The solvents used in the present invention include amides such as formamide, dimethylformamide, dimethylacetoamide, hexaneamide, etc.; alcohols such as methanol, ethanol, 1-propanol, 2-propanol, butanol, ethylene glycol, polyethylene glycol, etc. and esters such as ethyl acetate, ethyl benzoate, etc.; aromatic compounds such as benzene, o-dichlorobenzene, toluene, etc.; ketones such as acetone, methylethyl ketone, 3-pentanone, etc.; chlorinated hydrocarbons such as methylene chloride, chloroform, 1,1,2-trichloroethane, 1,1,2,2-tetrachloroethane, 1,1,2-trichloroethylene, etc.; dimethylsulfoxide; pyridine; tetrahydrofuran; dioxane; dicyanocyclobutane; 1-methyl-2-oxohexamethyleneimine, etc. In addition, water may be used if circumstances require.

In the actual preparation of the composition according to the present invention the ratios of the respective components may be selected suitably. However, in the case of the composition of color-forming system the quantity of photooxidant used preferably is in the range of 0.1–10 moles per mole of the color-developer (leuco-pigment). In the composition of non-color-forming system the quantity of cobalt complex used preferably is in the range of 0.1–10 moles per mole of the photoreductant, while the hydrogen donator may be used in excess moles per mole of the photoreductant. And, the ratio of color developer to photoreductant is suitable to be about 1:1–20 (mole). The quantity of binder is about 30–90% of the weight of each layer.

The recording element prepared by applying the said composition onto the support as stated above is applicable to photography, printing, pattern layout for metal working and so forth. Furthermore, in view of the fact that the composition according to the present invention, when incorporated as a component in a film which is liable to inactivation without being irradiated or subjected to heat- or chemical-treatment, permits said film to have a superior resolving power, said composition is also utilizable in the manufacture of microfilms.

Next, the image-forming method utilizing the composition according to the present invention will be explained with reference to the example of a mono-layer recording element.

First, reference will be made to the formation of a positive image. When the surface layer of said recording element is irradiated imagewise with visible light, the photoreductant, for instance, such as quinone, present in the exposed area of said surface layer absorbs this visible light and draws the hydrogen from the coexisting hydrogen donator, thereby forming hydroquinone, i.e., reducing agent. Next, when the surface layer is heated to a temperature of about 80°–150° C., cobalt (III) complex is reduced, thereby producing a basic substance such as $NH_3$ or the like in a chain reaction manner. This basic substance immediately functions to neutralize the acid present in the exposed area or trap the photooxidant such as hexaarylbiimidazole or the like present in the exposed area for inactivation or fixing. When the overall surface layer under such conditions is irradiated with ultraviolet ray, in the image area which has not been exposed to visible light, for instance, the hexaarylbiimidazole produces an imidazole radical which is operable to oxidize the color generator, for instance, leuco-pigment in cooperation with the action of the acid present in the image area and thus lead to color generation. And, the basic substance generated in a chain reaction manner in the above image forming method acts upon the color-forming system (that is, photooxidant, color generator and acid) so as to prevent the color generator from being oxidized.

The formation of a negative image, on the other hand, may be achieved by replacing the visible light used at the time of imagewise exposure in the aforesaid positive image forming method by ultraviolet ray, then irradiating the overall surface with visible light prior to heating treatment, and thereafter heating the same.

The photo-sensitive composition according to the present invention, which has employed, as its one component, cobalt complex (preferably, cobalt (III) complex), can react with the reducing agent produced by visible light irradiation in an amplifying manner so that the reaction of photooxidant may be suppressed, whereby a more clear-cut image can be obtained. In case of necessity, furthermore, the said photo-sensitive composition may contain a chelating agent capable of causing the aforegoing amplifying reaction, a photosensitizer capable of inducing the reducing agent production owing to visible light irradiation, etc. in addition to the previously mentioned acids.

The exemplary chelating agents which are effectively used in the present invention and capable of forming a bidentate ligand with Co (III) include for instance nitroso-arol, dithiooxiamide, formazan, aromatic azo-compound, hydrazone, Schiff's base.

DESCRIPTION OF THE PREFERRED EMBODIMENTS

EXAMPLE 1

| | |
|---|---|
| $[Co(NH_3)_6](CF_3COO)_3$ | 200 mg |
| Acetone | 9 ml |
| Isopropanol | 1 ml |
| Parabenzoquinone | 60 mg |
| 9,10-phenanthrenequinone | 10 mg |
| Polyethylene glycol | 500 mg |
| 2,2'-bis(o-chlorophenyl)-4,4'5,5'-tetraphenylbiimidazole | 132 mg |
| Tris(4-diethylamino-o-tolyl)methane | 50 mg |
| P-toluenesulfonic acid monohydrate | 40 mg |

A solution was prepared by adding the aforegoing components in the above mentioned order. A filter paper was impregnated with this solution and dried at 30° C. A part of the treated paper was exposed through a filter (UV39) to visible light of 50,000 luxes from a tungsten lamp repeatedly while changing the exposure times variously such as 4, 8.5, 12.5, 30 and 40 seconds. This sample was next passed through a pair of heating rollers heated to 130° C., and thereafter was subjected to a 5 seconds' overall ultraviolet ray exposure with a 20 W ultraviolet ray from a distance of 4 cm.

As a result of this, the areas exposed to visible light more than 12.5 seconds did not generate color even when irradiated with ultraviolet ray for 5 seconds, while the area not exposed to visible light was observed to generate a blue color having a density of more than 0.8.

For comparison sake, a filter paper was impregnated with the solution of the same composition except for the use of the cobalt complex. The thus treated paper was measured in respect of color generation through the same procedure except for the heat treatment at 130° C., which showed that it took 30 seconds or more until the image was fixed by exposure to a visible light.

EXAMPLE 2

| | |
|---|---|
| Acetone | 9 ml |
| Isopropanol | 1 ml |
| 2,2'-bis(o-chlorophenyl)-4,4'5,5'-tetraphenylbiimidazole | 132 mg |
| tris(4-diethylamino-o-tryl)methane | 50 mg |
| Parabenzoquinone | 60 mg |
| 9,10-phenanthrequinone | 10 mg |
| Polyethylene glycol | 480 mg |
| P-toluenesulfonic acid monohydrate | 40 mg |
| $[Co(NH)_6](CF_3COO)_3$ | 200 mg |
| Ethyl cellulose | 600 mg |

A solution was prepared by adding the aforegoing components in the above mentioned order. This solution was applied onto a 75 μm-thick polyethyleneterephthalate film using a 50 μm spacer and a 4 mill brade. The thus treated film was then allowed to air-dry to thereby obtain a photo-sensitive film having thereon an about 16 μm-thick photosensitive layer.

A positive image was superposed on this film, and the same was given a 15 second exposure with a tungsten lamp source. Then, it was passed through a pair of heating rollers heated to 130° C. and thereafter was given an overall ultraviolet ray irradiation identical with Example 1, thereby obtaining a blue colored positive image.

For comparison sake, a control photo-sensitive film was prepared by using the solution having the same composition as described above except for the use of the cobalt complex and was subjected to the same test procedure to find that it took 60 seconds until said control film produced the same image with a visible light exposure.

EXAMPLE 3

The addition of 5 mg of 1-(2-pyridylazo)-2-naphthol to the composition according to Example 2 showed that the time required for visible light exposure was reduced to seconds.

Example 4

| | |
|---|---|
| $[Co(NH)_6](CF_3COO)_3$ | 13.5 mg |
| Acetone-butanol(volume ratio 9:1) mixed solvent | 1 ml |
| Polyethylene glycol | 44 mg |
| Parabenzoquinone | 5.7 mg |
| 2,2'-bis(o-chlorophenyl)-4,4',5,5'-tetraphenylbiimidazol | 0.5 mg |
| Bis(4-diethylamino-o-tryl)-4-diethylaminophenylmethane | 0.6 mg |

A solution was prepared by adding the aforegoing components in the above mentioned order. A filter paper was impregnated with this solution and dried at 30° C. The treated paper was subjected to the same test procedure as Example 1. At the time of heating it to 130° C., however, a commercially available diazo photo-sensitive paper incorporated therein a coupler was superposed thereon for the purpose of investigating the occurrence of ammonia gas. As a result, it was observed that the portion of the diazo photo-sensitive paper opposite to the visible light-exposed area of the filter paper generated color while in the visible light-exposed area of the filter paper ammonia was generated by decomposition of the cobalt complex.

Example 5 through 9

| | |
|---|---|
| Acetone-isopropanol(volume ratio 9:1 mixed solvent | 10 ml |
| Cellulose acetate butyrate | 1 g |
| 2,2'-bis(o-chlorophenyl)-4,4',5,5'-tetraphenylbiimidazole | 132 mg |
| Bis(4-diethylamino-o-tolil)-4-diethylaminophenylmethane | 50 mg |
| P-toluene sulfonic acid monohydride | 20 mg |
| Polyethylene glycol | 0.5 g |
| 9,10-phenonthrequinone | 20 mg |
| Co(III)complex (which see Table-1) | 1 m mole |

A mixed solution having the above composition was applied onto a 100 μm-thick polyethylene terephthalate film by means of a 4 mill doctor blade. The thus coated film was dried at 50° C. for 20 minutes to thereby form a 13 μm-thick photo-sensitive layer.

The thus obtained mono-layer recording element was given a 60 second imagewise exposure with a visible light having a spectral energy distribution of 400–500 nm and an intensity of 400 $\mu W/cm^2$, was thermally treated for 30 seconds on a stainless plate heated to 90° C., and successively was given a 2 minutes' overall irradiation with ultraviolet radiation having an intensity of 150 $\mu W/cm^2$, whereby a superior positive-positive cyan image was formed. The observed results are set forth below in Table-1.

TABLE - 1

| Example | Co(III) complex | Image area density | Back-ground area density |
|---|---|---|---|
| 5 | Hexaammine cobalt (III) trifluoroacetate | 0.9 | 0.3 |
| 6 | Bis(ethylenediamine)diammine cobalt (III) perchlorate | 0.9 | 0.4 |
| 7 | Bis(ethylenediamine)diacetate cobalt (III) trifluoroacetate | 0.8 | 0.3 |
| 8 | Tris(ethylenediamine)cobalt (III) acetate | 0.9 | 0.3 |
| 9 | Tris(1,3-propanediamine)cobalt (III) trifluoroacetate | 1.1 | 0.3 |

Examples 10 through 14

| | |
|---|---|
| Acetone~isopropanol(volume ratio 9:1) mixed solvent | 10 ml |
| Polyvinyl butyral | 1 g |
| Hexaammine cobalt(III) trifluoroacetate | 500 mg |
| Photoreductant (which see Table-2) | Proper quantity (which see Table-2) |

A mixed solution having the above composition was applied onto a 100 μm-thick polyethylene terephthalate film by means of a 2 mill doctor blade. The thus coated film was air-dried, thereby forming a 6 μm-thick fixing layer. Next, a mixed solution having the following composition was applied onto said fixing layer by means of a 4 mill doctor blade and a 23 μm spacer and was air-dried to thereby form a 8 μm-thick color generating layer.

| | |
|---|---|
| Acetone | 10 ml |
| Cellulose acetate butyrate | 1 g |
| 2,2'-bis(o-chlorophenyl)-4,4',5,5'-tetraphenylbiimidazole | 132 mg |
| Bis(4-diethylamino-o-tolil)-4- | 50 mg |

-continued

| | |
|---|---|
| diethylaminophenylmethane | |
| p-toluene sulfonic acid | 40 mg |
| Polyethylene glycol | 0.5 g |

The same image forming method as disclosed in Example 5–9 was applied repeatedly to the thus prepared double-layer recording element, thereby obtaining a positive-positive cyan image. The observed results are set forth below in Table-2.

TABLE 2

| Example | Photoreductant | Quantity added (m mole) | Image area density | Background area density |
|---|---|---|---|---|
| 10 | 1,6- and 1,8-pyrenequinone | 0.3 | 1.1 | 0.3 |
| 11 | Diphenylmethyl 2-naphthyldisulfide | 4.0 | 0.9 | 0.5 |
| 12 | Phenyl-1-(1-phenoxy)benzil ketone | 5.0 | 0.9 | 0.3 |
| 13 | 2-isopropoxy-1,4-naphthoquinone | 5.0 | 0.8 | 0.4 |
| 14 | 2,2-diphenyl-2H-benziimidazole | 7.0 | 0.9 | 0.3 |

Examples 15 through 19

| | |
|---|---|
| Acetone~isopropanol(volume ratio 9:1) mixed solvent | 10 ml |
| Polyvinyl butyral | 1 g |
| Hexaammine cobalt(III) trifluoroacetate | 500 mg |
| 9,10-phenanthrequinone | 60 mg |

A mixed solution having the above composition was applied onto a 100 μm-thick polyethylene terephthalate film by means of a 2 mill doctor blade and the same was air-dried to thereby form a 6 μm-thick fixing layer. Subsequently, a 10 wt% aqueous solution of polyvinyl alcohol was applied onto said layer by means of a 2 mill doctor blade and a 23 μ spacer and then the same was dried at 50° C. for 20 minutes to thereby form a 4 μm-thick intermediate layer thereon. Still further, a mixed solution having the following composition was applied onto said layer by means of a 3 mill doctor blade and a 23 μm spacer and the same was air-dried to form a 6 μm-thick color generating layer.

| | |
|---|---|
| Acetone | 10 ml |
| Cellulose acetate butyrate | 1 g |
| 2,2'-bis(o-chlorophenyl)4,4',5,5'-tetraphenylbiimidazole | 132 mg |
| p-toluene sulfonic acid (which see Table-3) | Proper quantity (which see Table-3) |
| Color generator (leuco-pigment) (which see Table-3) | 0.1 m mole |
| Polyethylene glycol | 0.5 g |

The obtained three-layer recording material was given a 1 minute's imagewise exposure with ultraviolet radiation having an intensity of 150 $\mu W/cm^2$, succeedingly was given a 20 seconds' overall irradiation with a visible light having a spectral energy distribution of 400–500 nm and an intensity of 400 $\mu W/cm^2$ and further was thermally treated for 60 seconds on a stainless plate heated to 120° C., whereby a satisfactory negative-positive image was formed, the background area of which is light yellow. The observed results are set forth below in Table-3.

TABLE 3

| Example | Color generator (leuco-pigment) | p-tluene sulfonic acid | Color tone |
|---|---|---|---|
| 15 | Bis(4-diethylamino-o-tolil)-4-diethylaminophenyl methane | 30 mg | blue |
| 16 | Tris(p-hydroxyphenyl)methane | 30 mg | red |
| 17 | 3,6-bis(diethylamino)-9-(o-ethoxycarbonyl phenyl)-xanthene zinc chloride double salt | 0 | red |
| 18 | 9,10-dihydro-3,6-bis(diethylamino)-9-phenylacridine zinc chloride double salt | 0 | red |
| 19 | Phenothiazine | 35 mg | bluish green |

Examples 20 through 24

| | |
|---|---|
| Acetone~isopropanol(volume ratio 9:1) mixed solvent | 10 ml |
| Polyvinyl butyral | 1 g |
| Hexaammine cobalt(III) trifluoroacetate | 500 mg |
| 9,10-phenanthrequinone | 60 mg |

A mixed solution having the above composition was applied onto a 100 μm-thick polyethylene terephthalate film by means of a 2 mill doctor blade and the same was air-dried to thereby form a 6 μm-thick fixing layer. Subsequently, a 10 wt.% aqueous solution of polyvinyl alcohol was applied onto said layer by means of a 2 mill doctor blade and a 23 μm spacer and then the same was dried at 50° C. for 20 minutes to thereby form a 4 μm-thick intermediate layer. Still further, a mixed solution having the following composition was applied onto said layer by means of a 4 mill doctor blade and a 23 μm spacer and the same was air-dried, thereby forming a 8 μm-thick color generating layer.

| | |
|---|---|
| Acetone-isopropanol(volume ratio 9:1) | 10 ml |
| Polyvinyl butyral | 1 g |
| Bis(4-diethylamino-o-tolil)-4-diethylaminophenylmethane | 50 mg |
| p-toluene | 30 mg |
| Polyethylene glycol | 0.5 g |
| Photooxidant (which see Table-4) | Proper quantity (which see Table-4) |

The obtained three-layer recording element was given a 60 seconds' imagewise exposure with the same visible light source as employed in Example 5–9, then was subjected to a ten seconds' thermal treatment on a iron plate heated to 90° C., and successively was given a 2 minutes' overall irradiation with ultraviolet radiation, whereby a satisfactory positive-positive image was formed. The observed results are set forth below in Table-4.

TABLE 4

| Example | Photooxidant | Quantity added | Image area density | Background area density |
|---|---|---|---|---|
| 20 | 1-diacetylaminobenzotriazole | 1.0 | 1.2 | 0.3 |
| 21 | Carbon tetrabromide | 2.0 | 1.0 | 0.3 |
| 22 | 2,6-dimethyl-4-(1,1,3,3-tetrafluoro-1,3-dichloroisopropylidene)- | 5.0 | 1.0 | 0.3 |

TABLE 4-continued

| Example | Photooxidant | Quantity added | Image area density | Background area density |
|---|---|---|---|---|
| 23 | 2,5-cyclohexadiene tetracetylhydrozine | 0.4 | 1.4 | 0.3 |
| 24 | N,N,O-triacetyl-hydroxylamine | 1.0 | 1.0 | 0.3 |

What is claimed is:

1. A photo-sensitive, heat-sensitive composition, consisting essentially of:

a color-generating system consisting essentially of a mixture of: photooxidant capable of producing an oxidizing substance when irradiated with ultraviolet radiation, and leuco pigment capable of being oxidized by said oxidizing substance to generate a visible color; and a fixing system consisting essentially of a mixture of: photoreductant, hydrogen donator capable of supplying hydrogen to said photoreductant, said photoreductant being capable of producing a reducing substance, in the presence of said hydrogen donator, when irradiated with visible light, and cobalt (III) complex capable, when heated, of reacting with said reducing substance so that said cobalt complex is reduced and produces ammonia or an amine which is effective to suppress the reaction between said leuco pigment and said oxidizing substance in the area irradiated with visible light.

2. A composition according to claim 1 wherein the amount of said photooxidant is 0.1–10 moles per mole of said leuco pigment, the amount of said cobalt (III) complex is in the range of 0.1–10 moles per mole of said photoreductant, the amount of said hydrogen donator is in excess per mole of said photoreductant, and the molar ratio of said leuco pigment to said photoreductant is 1:1–20 moles.

3. A composition according to claim 1 containing from 30 to 90 wt. % of a binder resin.

4. A composition according to claim 1 in which said color-generating system contains from 1–10 moles of an acid per mole of said leuco pigment.

5. A recording element comprising a support and a photosensitive, heat-sensitive layer superposed on said support, said layer consisting essentially of a mixture of:

photooxidant capable of producing an oxidizing substance when irradiated with ultraviolet radiation, leuco pigment capable of being oxidized by said oxidizing substance to generate a visible color, photoreductant, hydrogen donator capable of supplying hydrogen to said photoreductant, said photoreductant being capable of producing a reducing substance, in the presence of said hydrogen donator, when irradiated with visible light, and cobalt (III) complex capable, when heated, of reacting with said reducing substance so that said cobalt complex is reduced and produces ammonia or an amine which is effective to suppress the reaction between said leuco pigment and said oxidizing substance in the area irradiated with visible light.

6. A recording element according to claim 5 wherein the amount of said photooxidant is 0.1–10 moles per mole of said leuco pigment, the amount of said cobalt (III) complex is in the range of 0.1–10 moles per mole of said photoreductant, the amount of said hydrogen donator is in excess per mole of said photoreductant, and the molar ratio of said leuco pigment to said photoreductant is 1:1–20 moles.

7. A recording element according to claim 5 wherein said layer contains from 30 to 90 wt. % of binder resin.

8. A recording element according to claim 5 wherein said layer contains from 1–10 moles of an acid per mole of said leuco pigment.

9. A recording element according to claim 5 wherein the thickness of said photo-sensitive and heat-sensitive layer is 5–40 μm.

10. A recording element according to claim 5 wherein said support is paper or a plastic film.

11. A photo-sensitive, heat-sensitive recording element comprising a support, a fixing layer superposed on said support, said fixing layer consisting essentially of a mixture of:

photoreductant, hydrogen donator capable of supplying hydrogen to said photoreductant, said photoreductant being capable of producing a reducing substance, in the presence of said hydrogen donator, when irradiated with visible light, and cobalt (III) complex capable, when heated, of reacting with said reducing substance so that said cobalt complex is reduced and produces ammonia or an amine, and a color-generating layer superposed on said fixing layer, said color-generating layer consisting essentially of a mixture of:

photooxidant capable of producing an oxidizing substance when irradiated with ultraviolet radiation, and leuco pigment capable of being oxidized by said oxidizing substance to generate a visible color, said ammonia or amine being effective to suppress the reaction between said leuco pigment and said oxidizing substance in the area irradiated by visible light.

12. A recording element according to claim 11 wherein the amount of said photooxidant is 0.1–10 moles per mole of said leuco pigment, the amount of said cobalt (III) complex is in the range of 0.1–10 moles per mole of said photoreductant, the amount of said hydrogen donator is in excess per mole of said photoreductant, and the molar ratio of said leuco pigment to said photoreductant is 1:1–20 moles.

13. A recording element according to claim 11 wherein the fixing and color-generating layers contain from 30 to 90 wt. % of binder resin.

14. A recording element according to claim 11 wherein said color-generating layer contains from 1–10 moles of acid, per mole of said leuco pigment.

15. A recording element according to claim 11 wherein the thickness of said fixing layer is 5–20 μm and the thickness of said color-generating layer is 1–20 μm.

16. A recording element according to claim 11 wherein a 1–10 μm-thick intermediate layer is interposed between said fixing layer and said color-generating layer.

17. A recording element according to claim 16 wherein the intermediate layer is made of a resin material.

* * * * *